US009872109B2

(12) United States Patent
Miller et al.

(10) Patent No.: US 9,872,109 B2
(45) Date of Patent: Jan. 16, 2018

(54) SHARED COIL RECEIVER

(71) Applicant: Knowles Electronics, LLC, Itasca, IL (US)

(72) Inventors: Thomas E. Miller, Arlington Heights (IL); Daniel Warren, Geneva, IL (US); Shehab Albahri, Hanover Park, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/950,651

(22) Filed: Nov. 24, 2015

(65) Prior Publication Data

US 2016/0183005 A1 Jun. 23, 2016

Related U.S. Application Data

(60) Provisional application No. 62/093,131, filed on Dec. 17, 2014.

(51) Int. Cl.

| | |
|---|---|
| ***H04R 25/00*** | (2006.01) |
| ***H04R 11/04*** | (2006.01) |
| ***H04R 31/00*** | (2006.01) |

(52) U.S. Cl.

CPC ..... *H04R 11/04* (2013.01); *H04R 31/006* (2013.01)

(58) Field of Classification Search

USPC ..... 381/312

See application file for complete search history.

(56) References Cited

U.S. PATENT DOCUMENTS

| | | | |
|---|---|---|---|
| 1,962,012 | A | 6/1934 | Grassmann |
| 2,751,444 | A | 6/1956 | Koch |
| 2,864,064 | A | 12/1958 | Heaton |
| 2,983,797 | A | 5/1961 | Lybarger |

(Continued)

FOREIGN PATENT DOCUMENTS

| | | |
|---|---|---|
| CN | 203840067 | 9/2014 |
| CN | 203840177 | 9/2014 |

(Continued)

OTHER PUBLICATIONS

International Search Report and Written Opinion for PCT/US2015/063409 dated Mar. 22, 2016 (9 pages).

(Continued)

*Primary Examiner* — Amir Etesam

(74) *Attorney, Agent, or Firm* — Faegre Baker Daniels LLP

(57) ABSTRACT

An apparatus includes a coil; a stationary core, wherein the coil is wound about a portion the stationary core; a first magnetic structure and a second magnetic structure, wherein the first magnetic structure and the second magnetic structure are coupled to the stationary core; a first armature having a first end of the first armature and a second end of the first armature, wherein the first end of the first armature is coupled to the stationary core and the second end of the first armature is disposed within the first magnetic structure; and a second magnetic armature having a first end of the second armature and second end of the second armature, wherein the first end of the second armature is coupled to the stationary core and the second end of the second armature is disposed within the second magnetic structure.

20 Claims, 2 Drawing Sheets

(56) References Cited

U.S. PATENT DOCUMENTS

| | | | |
|---|---|---|---|
| 3,076,062 | A | 1/1963 | Fener |
| 3,124,785 | A | 3/1964 | Seretny et al. |
| 3,413,424 | A | 11/1968 | Carlson |
| 3,560,667 | A | 2/1971 | Carlson |
| 3,614,335 | A | 10/1971 | Edgware et al. |
| 3,627,930 | A | 12/1971 | Toman |
| 3,649,939 | A | 3/1972 | Hildebrandt |
| 3,721,932 | A | 3/1973 | Fierstien et al. |
| 3,873,784 | A | 3/1975 | Doschek |
| 3,935,398 | A | 1/1976 | Carlson |
| 3,982,814 | A | 9/1976 | Kaiserswerth et al. |
| 4,109,116 | A | 8/1978 | Victoreem |
| 4,271,333 | A | 6/1981 | Adams et al. |
| 4,291,202 | A | 9/1981 | Adams et al. |
| 4,292,477 | A | 9/1981 | Adams et al. |
| 4,314,220 | A | 2/1982 | Ito et al. |
| 4,331,840 | A | 5/1982 | Murphy et al. |
| 4,404,489 | A | 9/1983 | Larson et al. |
| 4,473,722 | A | 9/1984 | Wilton |
| 4,507,637 | A | 3/1985 | Hayashi |
| 4,578,664 | A | 3/1986 | Kinzler et al. |
| 4,710,961 | A | 12/1987 | Buttner |
| 4,759,120 | A | 7/1988 | Berstein |
| 4,764,690 | A | 8/1988 | Murphy et al. |
| 4,783,815 | A | 11/1988 | Buttner |
| 4,868,637 | A | 9/1989 | Clements et al. |
| 4,890,329 | A | 12/1989 | Erbe |
| 4,912,769 | A | 3/1990 | Erbe |
| 5,101,435 | A | 3/1992 | Carlson |
| 5,124,681 | A | 6/1992 | Chen |
| 5,193,116 | A | 3/1993 | Mostardo |
| 5,594,386 | A | 1/1997 | Dhuyvetter |
| 5,594,805 | A | 1/1997 | Sakamoto et al. |
| 5,610,989 | A | 3/1997 | Salvage |
| 5,647,013 | A | 7/1997 | Salvage |
| 5,708,721 | A | 1/1998 | Salvage |
| 5,757,947 | A | 5/1998 | Van Halteren et al. |
| 5,812,598 | A | 9/1998 | Sharma et al. |
| 5,828,767 | A | 10/1998 | Button |
| 5,857,123 | A | 1/1999 | Miyamoto et al. |
| 5,858,154 | A | 1/1999 | Toki |
| 6,041,131 | A | 3/2000 | Kirchhoefer |
| 6,075,870 | A | 6/2000 | Geschiere et al. |
| 6,563,933 | B1 | 5/2003 | Niederdraenk |
| 6,630,639 | B2 | 10/2003 | McSwiggin |
| 6,654,477 | B1 | 11/2003 | Miller |
| 6,658,134 | B1 | 12/2003 | van Hal et al. |
| 6,738,490 | B2 | 5/2004 | Brandt |
| 7,050,602 | B2 | 5/2006 | Miller |
| 7,103,196 | B2 | 9/2006 | Warren |
| 7,164,776 | B2 | 1/2007 | Miller |
| 7,203,334 | B2 | 4/2007 | Schafer |
| 7,236,609 | B1 | 6/2007 | Tsangaris |
| 7,336,797 | B2 | 2/2008 | Thompson |
| 7,362,878 | B2 | 4/2008 | Miller |
| 7,366,317 | B2 | 4/2008 | Miller |
| 7,415,125 | B2 | 8/2008 | Warren |
| 7,443,997 | B2 | 10/2008 | Miller |
| 7,817,815 | B2 | 10/2010 | Miller |
| 7,860,264 | B2 | 12/2010 | Jiles |
| 7,921,540 | B2 | 4/2011 | Jiles |
| 7,925,041 | B2 | 4/2011 | Jiles |
| 7,995,789 | B2 | 8/2011 | Tsangaris |
| 8,027,492 | B2 | 9/2011 | Miller |
| 8,233,646 | B2 | 7/2012 | Lutz |
| 8,385,583 | B2 | 2/2013 | Thompson |
| 8,494,209 | B2 | 7/2013 | Miller |
| 8,824,726 | B2 | 9/2014 | Miller |
| 8,837,755 | B2 | 9/2014 | Jiles |
| 9,137,605 | B2 | 9/2015 | Manley |
| 9,137,610 | B2 | 9/2015 | Jiles |
| 9,401,768 | B2 | 7/2016 | Inha et al. |
| 2002/0003890 | A1 | 1/2002 | Warren |
| 2002/0142795 | A1 | 10/2002 | Imahori |
| 2004/0258260 | A1 | 12/2004 | Thompson et al. |
| 2007/0036378 | A1 | 2/2007 | Saltykov |
| 2007/0133834 | A1 | 6/2007 | van Halteren |
| 2007/0258616 | A1 | 11/2007 | Tsangaris |
| 2008/0049967 | A1 | 2/2008 | Adelman |
| 2008/0226115 | A1* | 9/2008 | Beekman ..... H04R 11/02 381/417 |
| 2009/0147983 | A1 | 6/2009 | Jiles |
| 2010/0054509 | A1* | 3/2010 | Thompson ..... H04R 11/02 381/312 |
| 2010/0128905 | A1 | 5/2010 | Warren et al. |
| 2012/0155694 | A1 | 6/2012 | Reeuwijk |
| 2012/0255805 | A1* | 10/2012 | van Halteren ..... H04R 1/2873 181/199 |
| 2013/0190552 | A1 | 7/2013 | Leblans |
| 2014/0153737 | A1 | 6/2014 | Geschiere |
| 2015/0086049 | A1 | 3/2015 | Jiles |
| 2015/0110338 | A1 | 4/2015 | McCratic |
| 2015/0373456 | A1 | 12/2015 | Dayton |
| 2016/0044420 | A1 | 2/2016 | Albahri |

FOREIGN PATENT DOCUMENTS

| | | | |
|---|---|---|---|
| CN | 203840179 | | 9/2014 |
| CN | 203872027 | | 10/2014 |
| CN | 203933199 | | 11/2014 |
| CN | 203951282 | | 11/2014 |
| CN | 203951286 | | 11/2014 |
| CN | 203951601 | | 11/2014 |
| CN | 204046390 | | 12/2014 |
| CN | 204046391 | | 12/2014 |
| CN | 204118999 | | 1/2015 |
| CN | 204119001 | | 1/2015 |
| CN | 204168459 | | 2/2015 |
| CN | 204206439 | | 3/2015 |
| CN | 204206440 | | 3/2015 |
| CN | 204206443 | | 3/2015 |
| CN | 204206445 | | 3/2015 |
| CN | 204206446 | | 3/2015 |
| CN | 204206447 | | 3/2015 |
| CN | 204206448 | | 3/2015 |
| CN | 204206449 | | 3/2015 |
| CN | 204291354 | | 4/2015 |
| CN | 204350281 | | 5/2015 |
| CN | 204350282 | | 5/2015 |
| CN | 204350283 | | 5/2015 |
| CN | 204350284 | | 5/2015 |
| CN | 204350285 | | 5/2015 |
| CN | 204350286 | | 5/2015 |
| CN | 105050010 | | 11/2015 |
| DE | 3220737 | A1 | 12/1983 |
| DE | 3502178 | A1 | 8/1985 |
| DE | 3511802 | A1 | 10/1986 |
| DE | 3615307 | A1 | 11/1987 |
| DE | 3616773 | A1 | 11/1987 |
| EP | 0533284 | A1 | 3/1993 |
| EP | 1247427 | | 11/2003 |
| JP | 55105498 | A | 8/1980 |
| JP | 55121795 | A | 9/1980 |
| JP | 10-032897 | | 3/1998 |
| JP | 10-106855 | | 4/1998 |
| JP | 2000058357 | A | 2/2000 |
| JP | 2002-300698 | A | 10/2002 |
| JP | 2005049311 | A | 2/2005 |
| JP | 4876293 | | 2/2012 |
| JP | 2013-138292 | | 7/2013 |
| WO | 2013/010384 | A1 | 1/2013 |

OTHER PUBLICATIONS

Korean Intellectual Property Office, International Search Report and Written Opinion for International Application No. PCT/US2015/043800, mailed Nov. 13, 2015.

U.S. Patent and Trademark Office; U.S. Appl. No. 14/818,787; Non-Final Office Action; dated May 6, 2016.

U.S. Patent and Trademark Office; U.S. Appl. No. 14/818,787; Final Office Action; dated Nov. 2, 2016.

(56) References Cited

OTHER PUBLICATIONS

U.S. Patent and Trademark Office; U.S. Appl. No. 14/818,787; Advisory Action; dated Jan. 18, 2017.
U.S. Patent and Trademark Office; U.S. Appl. No. 14/949,029; Non-Final Action; dated Nov. 14, 2016.
Korean Intellectual Property Office, International Search Report and Written Opinion for International Application No. PCT/US2015/062418, mailed Mar. 28, 2016.
Henney, Keith; The Radio Engineering Handbook; third Edition; McGraw-Hill Book Company, Inc.; 1941; pp. 34-85.
Electronic Engineers of the Westinghouse Electric Corporation; Industrial Electronics Reference Book; John Wiley & Sons, Inc.; 1948.
Langford-Smith, F.; Radiotron Designer's Handbook; Fourth Edition; 1953; pp. 450-481.
Terman, Frederick Emmons; Radio Engineering; Third Edition; 1947; pp. 30-39.
International Preliminary Examination Report; International Application No. PCT/US01/41755; dated Nov. 11, 2002.
International Search Report; International Application No. PCT/US01/41755; dated Jul. 22, 2002.

* cited by examiner

SHARED COIL RECEIVER

CROSS-REFERENCE TO RELATED APPLICATION

This application claims the benefit of U.S. Provisional Patent Application Ser. No. 62/093,131, filed Dec. 17, 2014, entitled SHARED COIL RECEIVED which is incorporated by reference in its entirety herein.

FIELD OF THE DISCLOSURE

This application relates to receivers and the components utilized with these devices.

BACKGROUND

Various receivers have been used through the years. In these devices, different electrical components are housed together within a housing or assembly. For example, a receiver typically includes a coil, bobbin, stack, among other components and these components are housed within the receiver housing. Other types of acoustic devices may include other types of components. The motor typically includes a coil, a yoke, such as a stack and an armature, which together form a magnetic circuit.

Receivers can be used in many applications such as hearing instruments. These devices may be used in other applications such as personal computers or cellular telephones as well.

As mentioned, receivers have an armature. The armature is a moving component and moves as an electrical current creates a changing magnetic field in the receiver. The movement of the armature creates sound, which can be presented to a listener.

The motion of the armature causes a reactionary force in the receiver housing, which in turn causes motion of the device in which the receiver is mounted. In a hearing instrument, this motion may be picked up by the hearing instrument microphone, contaminating the signal going to the receiver and leading to feedback and oscillation. If a pair of receivers is mounted back to back, their vibratory forces will be oriented in opposing directions and will tend to cancel each other, producing a low vibration system.

Another issue that arises with receivers is that they are deployed in devices where space is at a premium. Consequently, if the receiver becomes too big it may not be practical to deploy the receiver in the device. Previous devices also have become expensive, in some situations.

These problems have created some user dissatisfaction with previous approaches.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present approaches provide a balanced armature receiver having one coil that is used to drive two armatures. This goal is achieved by winding the coil around a stationary magnetic core member that is then joined to two armatures. Each motor otherwise has a conventional magnetic design, having a pair of magnets and a yoke. The approaches presented herein save cost, since the coil is an expensive component in the receiver. These approaches also save space, since only one coil needed.

Figure 1:
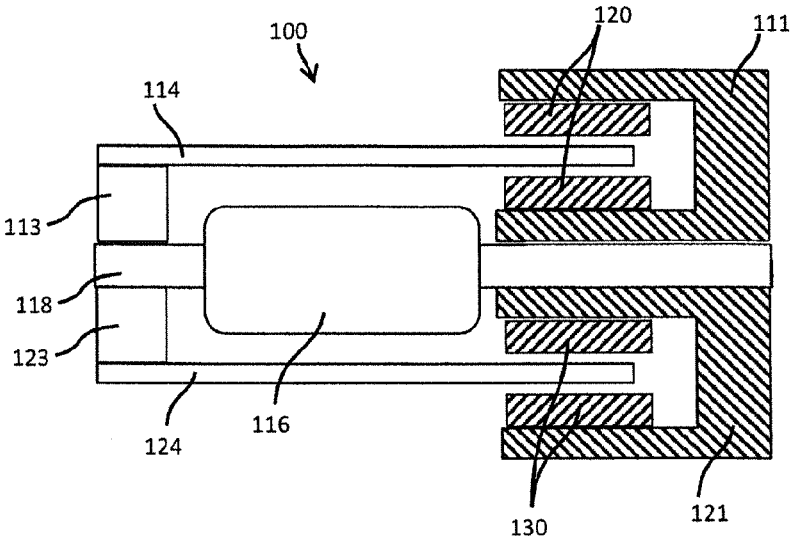
FIG. 1 comprises a side cutaway view of an acoustic motor according to various embodiments of the present invention.

Referring now to FIG. 1, one example of a motor 100 is described. The motor includes a core 118, support blocks 113 and 123, yokes 111 and 121. The core 118, support blocks 113 and 123, and yokes 111 and 121 are made of highly permeable magnetic material.

The motor 100 also includes a coil 116, magnets 120 and 130, and armatures 114 and 124. The coil 116 is wound around a fixed core 118. Armatures 114 and 124 are connected to the core 118 by support blocks 113 and 123. Yokes 111 and 121 are connected to end of the core 118 opposite the armature end. Magnets 120 and 130 are mounted to magnetic yokes 111 and 121. Magnets 120 will have an opposite magnetic orientation to the magnets 130.

Operation of each armature and its corresponding pair of magnets and yoke is similar to traditional balanced armature receivers. More specifically, when coil 116 is energized by a current, the free end of the armature will be attracted to one magnet, and repelled by the other. If the charge of magnets 120 is opposed to the charge of magnets 130, the motion of armature 114 will be opposed to the motion of armature 124. This mode of operation makes it easy to configure diaphragms so that air moved by one diaphragm adds to the air moved by the other diaphragm.

Figure 2:
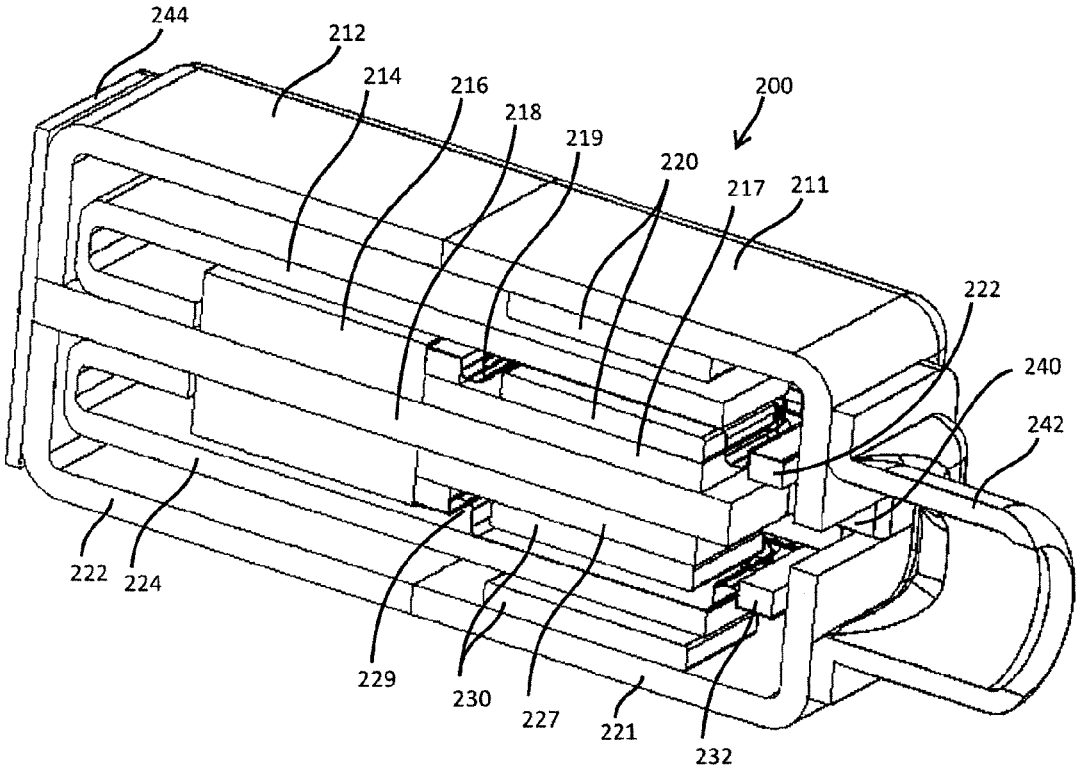
FIG. 2 comprises a perspective cut away view of a receiver according to various embodiments of the present invention.
Figure 3:
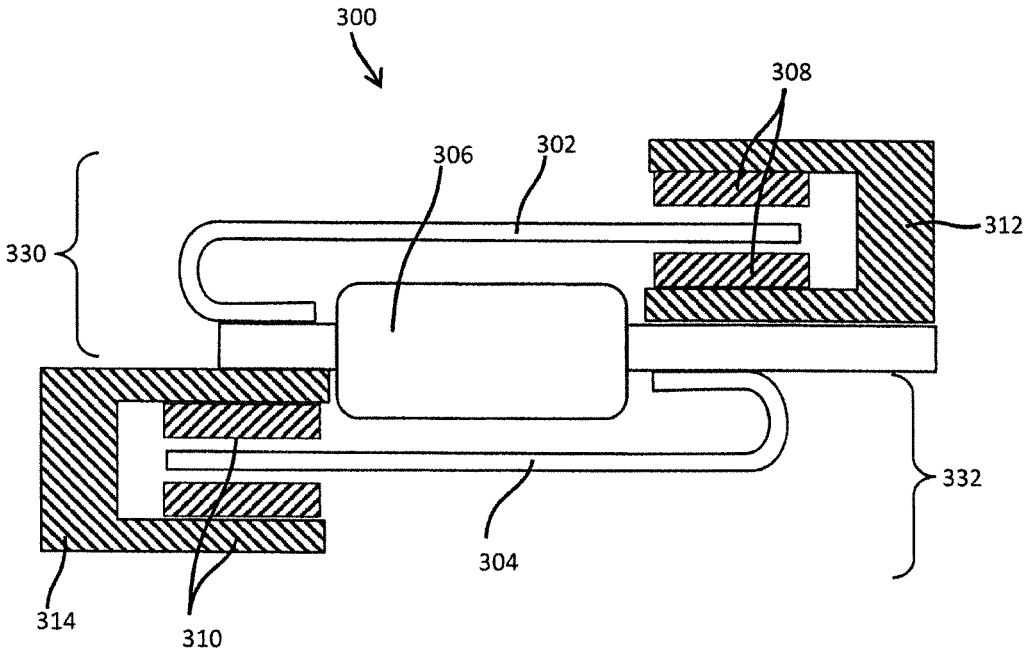
FIG. 3 comprises a side cutaway view of another example of an acoustic motor according to various embodiments of the present invention.

Referring now to FIG. 2, a receiver including a motor is described. Items that correspond to the same items in FIG. 1 have the same corresponding numbers and the description of these components or operation will not be repeated here. In the approach of FIG. 2 and FIG. 3, the blocks 113 and 123 have been eliminated by bending the fixed end of armatures 214 and 224 into a U shape. The yokes 111 and 121 in FIG. 1 have been replaced with housing portions 211 and 221 in FIG. 2. Supports 217 and 227 may be used to make room for a larger coil, while still placing the armature centered between magnets.

Supports 217 and 227 are made from highly permeable magnetic material. Diaphragm films 219 and 229 are attached to the free ends of armatures 214 and 224, so that motion of the armatures forces air through opening 240. Sound is directed through port tube 242. Diaphragm films are supported by diaphragm rings 222 and 232. These rings 222 and 232 are sealed to housing portions 211 and 221 to prevent air from leaking around the diaphragms.

Housing portions 212 and 222 are made of non-magnetic material, to prevent creating an unwanted path for magnetic flux between core 218 and housing portions 211 and 221. This leakage path will reduce the action of the magnetic motor. Terminal board 244 provides electrical connections to the coil.

It will be appreciated that the diaphragms described herein can be of any type known to those skilled in the art such as where they are separate from the motor, and the motor connects to diaphragm via a drive pin or strap. It will also be understood that the yokes described herein can be part of (incorporated or formed with) the housing, or the housing can take the place of the yoke. It will be appreciated that the parting line (or dividing line) between magnetic and non-magnetic portions of the housing does not need to be near the middle of the housing. This line can be moved near the terminal end to provide additional shielding or simplify assembly.

Additionally, the armature does not have to be U-shaped as described herein. Instead, the armatures can be configured according to other shapes such as E-shaped, or in flat or other configurations. Other folds or shapes are possible. Finally, it will be understood that the supports 217 and 227 are optional.

Referring now to FIG. 3, another example of a motor 300 is described. The motor includes a first armature 302, a second armature 304, a coil 306, magnets 308 and 310, a first yoke 312, a second yoke 314, and a core (around which single coil 306 is wound). The construction and function of these components is similar to the example of FIG. 1, and this will not be repeated here. A first (upper) receiver 330 and a second (lower) receiver 332 are formed.

In the example of FIG. 3, the orientation of the armatures 302 and 304 are set in an opposing arrangement. In other words, the armatures 302 and 304 do not extend from the same side of the motor 300, but from different sides of the motor 300. This arrangement moves the magnets 308 of the upper receiver 330 away from the magnets 310 of the lower receiver 332, which may make it easier to calibrate the charge on one pair of magnets 308 independently of the calibration of the second pair of magnets 310.

It can be seen that as compared with the motor of FIG. 1, the orientation of the second receiver 332 has been flipped relative to the first receiver 330. This moves the magnet pairs 308 and 310 to opposite ends of the motor 300, which would make it easier to individually adjust the charge on each of the magnets 308 and 310. Calibrating the magnet charge enables precisely balancing the magnetic forces, reducing distortion and improving the vibration cancelling effect of the two receivers.

Preferred embodiments are described herein, including the best mode known to the inventors. It should be understood that the illustrated embodiments are exemplary only, and should not be taken as limiting the scope of the invention defined by the appended claims.

What is claimed is:

1. An apparatus comprising:

a coil;

a stationary core, wherein the coil is wound about a portion of the stationary core;

a first magnetic structure and a second magnetic structure, wherein the first magnetic structure and the second magnetic structure are coupled to the stationary core;

a first armature having a first end of the first armature and a second end of the first armature, wherein the first end of the first armature is coupled to the stationary core and the second end of the first armature is disposed within the first magnetic structure;

a second armature having a first end of the second armature and second end of the second armature, wherein the first end of the second armature is coupled to the stationary core and the second end of the second armature is disposed within the second magnetic structure.

2. The apparatus of claim 1, wherein excitation of the coil is effective to move one or more of the first armature and the second armature.

3. The apparatus of claim 1, wherein the stationary core includes a first end of the stationary core and a second end of the stationary core, and wherein the first magnetic structure and the second magnetic structure are coupled to the second end of the stationary core.

4. The apparatus of claim 1, wherein the stationary core includes a first end of the stationary core and a second end of the stationary core, and wherein the first magnetic structure is coupled to the first end of the stationary core and the second magnetic structure is coupled to the second end of the magnetic structure.

5. The apparatus of claim 1, wherein one or more of the first armature and the second armature are U-shaped.

6. The apparatus of claim 1, wherein one or more of the first armature and the second armature are E-shaped.

7. The apparatus of claim 1, wherein the first magnetic structure and the second magnetic structure have opposite magnetic orientations.

8. The apparatus of claim 1, wherein the stationary core comprises a magnetically permeable material.

9. The apparatus of claim 1, wherein the magnetic structures include permanent magnets.

10. An acoustic receiver comprising:

an electrical coil wound about a non-moving core having a first portion on one side of the electrical coil and a second portion on an opposite side of the electrical coil, the first and second portions of the non-moving core having opposite sides;

a first pair of permanent magnets disposed in space-apart relation adjacent one side of the first portion of the non-moving core;

a second pair of permanent magnets disposed in space-apart relation adjacent the opposite side of the first portion of the non-moving core;

a first armature coupled to the second portion of the non-moving core, the first armature including a portion disposed and movable between the first pair of permanent magnets;

a second armature coupled to the second portion of the non-moving core, the second armature including a portion disposed and movable between the second pair of permanent magnets, wherein application of an excitation signal to the electrical coil causes movement of at least one of the first armature between the first pair of permanent magnets or the second armature between the second pair of permanent magnets.

11. The receiver of claim 10 further comprising: a first discrete element stacked between the first armature and the non-moving core; and a second discrete element stacked between the second armature and the non-moving core.

12. The receiver of claim 11 further comprising a first yoke retaining the first pair of permanent magnets; and a second yoke retaining the second pair of permanent magnets, wherein the non-moving core, the first yoke, the second yoke, the first discrete element, and the second discrete element comprise a material with a high magnetic permeability.

13. The receiver of claim 12, wherein the first yoke comprises discrete elements and wherein the second yoke comprises discrete elements.

14. The receiver of claim 12, wherein the first yoke comprises a unitary element and wherein the second yoke comprises a unitary element.

15. The receiver of claim 10, wherein the first armature has a U-shape with a portion coupled to the non-moving core and the second armature has a U-shape with a portion coupled to the non-moving core.

16. An acoustic receiver comprising:

an electrical coil wound about a non-moving core having a first side and a second side opposite the first side;

a first pair of permanent magnets disposed in space-apart relation adjacent one side of the non-moving core;

a second pair of permanent magnets disposed in space-apart relation adjacent the opposite side of the non-moving core;

a first armature coupled to the non-moving core, the first armature including a portion disposed and movable between the first pair of permanent magnets;

a second armature coupled to the non-moving core, the second armature including a portion disposed and movable between the second pair of permanent magnets.

17. The receiver of claim 16 further comprising: a first discrete element stacked between the first armature and the non-moving core; and a second discrete element stacked between the second armature and the non-moving core.

18. The receiver of claim 11 further comprising a first yoke retaining the first pair of permanent magnets; and a second yoke retaining the second pair of permanent magnets, wherein the non-moving core, the first yoke, the second yoke, the first discrete element, and the second discrete element comprise a material with a high magnetic permeability.

19. The receiver of claim 16, wherein the non-moving core includes a first portion on one side of the electrical coil and a second portion on an opposite side of the electrical coil, the first pair of permanent magnets are disposed in space-apart relation adjacent the first portion of the non-moving core, the second pair of permanent magnets disposed in space-apart relation adjacent the second portion of the non-moving core, the first armature coupled to the second portion of the non-moving core, and the second armature coupled to the first portion of the non-moving core.

20. The receiver of claim 19, wherein the first pair of permanent magnets have an opposite polarity relative to the second pair of permanent magnets, and wherein the first armature is movable between the first pair of permanent magnets and the second armature is movable between the second pair of permanent magnets upon application of an excitation signal to the electrical coil.

* * * * *